US007824280B2

(12) United States Patent
Yokota

(10) Patent No.: US 7,824,280 B2
(45) Date of Patent: Nov. 2, 2010

(54) GOLF CLUB HEAD

(75) Inventor: Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 53 days.

(21) Appl. No.: 12/230,088

(22) Filed: Aug. 22, 2008

(65) Prior Publication Data

US 2009/0118034 A1 May 7, 2009

(30) Foreign Application Priority Data

Nov. 7, 2007 (JP) ..... 2007-289629

(51) Int. Cl.
*A63B 53/04* (2006.01)
*A63B 53/06* (2006.01)

(52) U.S. Cl. ..... 473/334

(58) Field of Classification Search ..... 473/324–350, 473/256

See application file for complete search history.

(56) References Cited

U.S. PATENT DOCUMENTS

| | | | | | |
|---|---|---|---|---|---|
| 2,098,445 | A | * | 11/1937 | Wettlaufer | 473/333 |
| 2,155,830 | A | * | 4/1939 | Howard | 473/246 |
| 2,171,383 | A | * | 8/1939 | Wettlaufer | 473/335 |
| 2,652,256 | A | * | 9/1953 | Thomas | 473/333 |
| 3,136,546 | A | * | 6/1964 | Connolly | 473/234 |
| 3,199,874 | A | * | 8/1965 | Blasing | 473/244 |
| 3,220,733 | A | * | 11/1965 | Saleeby | 473/335 |
| 5,230,509 | A | * | 7/1993 | Chavez | 473/336 |
| 5,683,309 | A | * | 11/1997 | Reimers | 473/337 |
| 5,709,611 | A | * | 1/1998 | Intag | 473/236 |
| 5,916,042 | A | * | 6/1999 | Reimers | 473/334 |
| 6,015,354 | A | * | 1/2000 | Ahn et al. | 473/256 |
| 6,386,987 | B1 | * | 5/2002 | Lejeune, Jr. | 473/219 |
| 6,821,212 | B2 | * | 11/2004 | Fowler et al. | 473/236 |
| 7,108,609 | B2 | * | 9/2006 | Stites et al. | 473/256 |
| 7,166,041 | B2 | * | 1/2007 | Evans | 473/334 |
| 7,611,424 | B2 | * | 11/2009 | Nagai et al. | 473/334 |
| 2006/0058112 | A1 | * | 3/2006 | Haralason et al. | 473/334 |
| 2006/0240907 | A1 | * | 10/2006 | Latiri | 473/334 |

FOREIGN PATENT DOCUMENTS

| | | | | |
|---|---|---|---|---|
| JP | 9-28844 | A | | 2/1997 |
| JP | 2003062131 | A | * | 3/2003 |
| JP | 2006223788 | A | * | 8/2006 |
| JP | 2006-288882 | A | | 10/2006 |
| JP | 2006-320493 | A | | 11/2006 |
| JP | 2006320493 | A | * | 11/2006 |
| WO | WO-2004/043549 | A1 | | 5/2004 |

* cited by examiner

*Primary Examiner*—Alvin A Hunter
(74) *Attorney, Agent, or Firm*—Birch, Stewart, Kolasch & Birch, LLP

(57) ABSTRACT

A head includes a head body, an additional member in which a contour shape obtained by a projection onto a plane has a rotational symmetric axis, and a holding mechanism for holding the additional member. The head body has a recess portion in which at least a part of the additional member can be fitted. The holding mechanism is constituted to enable a mutual transition of a holding state in which the additional member is held in the recess portion and a releasing state in which the hold is released. The recess portion inhibits a rotation around the rotational symmetric axis of the additional member in the holding state. The additional member is rotatable around the rotational symmetric axis in the releasing state. A phase of the additional member in the holding state is changed so that a position of a center of gravity of the head can be varied.

5 Claims, 15 Drawing Sheets

GOLF CLUB HEAD

This application claims priority on Patent Application No. 2007-289629 filed in JAPAN on Nov. 7, 2007, the entire contents of which are hereby incorporated by reference.

BACKGROUND OF THE INVENTION

1. Field of the Invention

The present invention relates to a golf club head.

2. Description of the Related Art

As a characteristic of a golf club head, a position of a center of gravity is important. Depending on the position of the center of gravity, for example, a position of a sweet spot SS or a moment of inertia might fluctuate. The position of the center of gravity of the head influences a flight distance and a trajectory.

An optimum position of the center of gravity is varied every golf player. Also in the same golf player, the optimum position of the center of gravity might be changed depending on a playing condition.

There has been proposed a golf club head capable of changing a position of a center of gravity. Japanese Laid-Open Patent Publication No. 9-28844 has disclosed a golf club head including a weight member which is screwed into a screw stock. The weight member can be moved through a rotation of the screw stock. Japanese Laid-Open Patent Publication No. 2006-288882 has disclosed a golf club head in which a plurality of weights is disposed in a body of a head portion and a position of a center of gravity can be changed through an exchange of the weights. Japanese Laid-Open Patent Publication No. 2006-320493 has disclosed a golf club head in which a position of a center of gravity can be changed through a movement of a weight member. The movement includes a rotating movement. Japanese Laid-Open Patent Publication No. 2006-505367 has disclosed a golf club head having a removable weight. WO2004/043549 A1 corresponds to the Japanese Laid-Open Patent Publication No. 2006-505367.

SUMMARY OF THE INVENTION

In order to change a position of a center of gravity, a combination of a head body and a center-of-gravity adjusting member is effective. In use of a golf club, it is demanded that the center-of-gravity adjusting member is fixed to the head body. A golf club head capable of easily changing the position of the center of gravity while meeting the demand is preferable.

It is an object of the present invention to provide a head capable of enhancing an easiness of a change in a position of a center of gravity and reliably fixing a center-of-gravity adjusting member.

A golf club head according to the present invention includes a head body, an additional member in which a contour shape obtained by a projection onto a plane has a rotational symmetric axis, and a holding mechanism for holding the additional member. The head body has a recess portion in which at least a part of the additional member can be fitted. The holding mechanism is constituted to enable a mutual transition of a holding state in which the additional member is held in the recess portion and a releasing state in which the hold is released. The recess portion inhibits a rotation around the rotational symmetric axis of the additional member in the holding state. The additional member is rotatable around the rotational symmetric axis in the releasing state. A phase of the additional member in the holding state is changed so that a position of a center of gravity of the head can be varied.

It is preferable that the contour shape of the additional member should be N-fold rotational symmetric, and N should be a natural number of three or more.

It is preferable that a through hole should be provided on a bottom face portion of the recess portion. It is preferable that a bar-shaped member which can be inserted into the through hole should be protruded from an internal surface of the additional member and one of ends of the bar-shaped member should be provided with the additional member. It is preferable that the other end of the bar-shaped member should be provided with an engaging portion which cannot be inserted into the through hole. It is preferable that a central axis of the bar-shaped member should be coincident with the rotational symmetric axis of the additional member. It is preferable that the bar-shaped member should be inserted into the through hole. It is preferable that the internal surface of the additional member should abut on the bottom face of the recess portion in the holding state.

It is preferable that the additional member should be formed by at least two materials having different specific gravities from each other. It is preferable that an elastic member should be provided between an internal surface of the bottom face portion and the engaging portion. It is preferable that the elastic member should perform biasing to increase an interval between the internal surface of the bottom face portion and the engaging portion in the holding state. It is preferable that the elastic member should be elastically deformable to take the releasing state.

It is preferable that an elastic member should be disposed in at least a part between a side surface of the additional member and a wall surface of the recess portion.

The position of the center of gravity can easily be changed through the rotation of the additional member. Moreover, the additional member can be reliably fixed through the recess portion.

DESCRIPTION OF THE PREFERRED EMBODIMENTS

The present invention will be described below in detail based on preferred embodiments with reference to the drawings.

Figure 1:
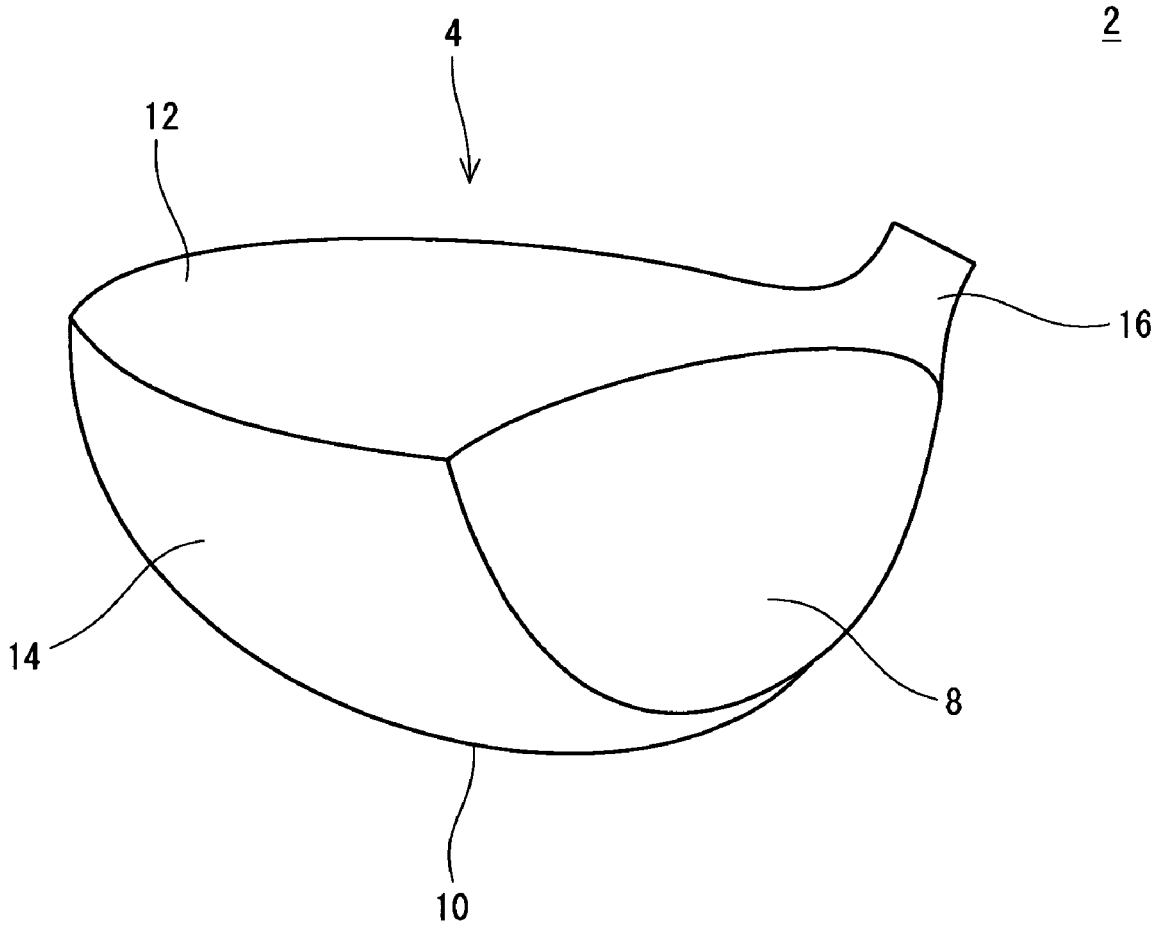
FIG. 1 is a perspective view showing a golf club head according to an embodiment of the present invention.
Figure 2:
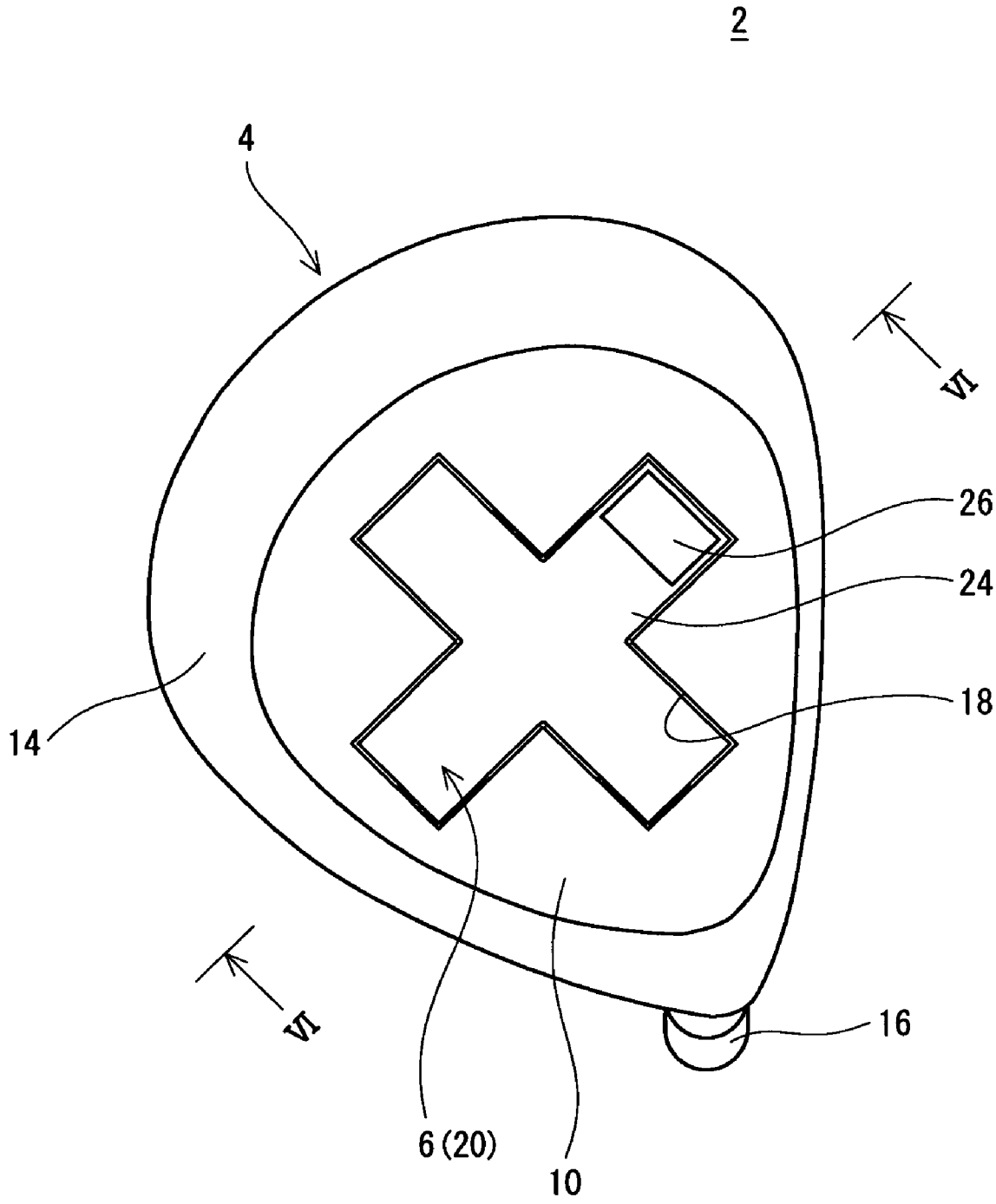
FIG. 2 is a perspective view showing the golf club head of FIG. 1 as seen in another direction.

FIG. 1 is a perspective view seen from a face side and FIG. 2 is a perspective view seen from a sole side. In the present embodiment, a head 2 is a golf club head of a wood type. The head 2 includes a head body 4 and an additional member 6.

The head body 4 has a face portion 8, a sole portion 10, a crown portion 12, a side portion 14 and a hosel portion 16. An inner part of the head body 4 is hollow, which is not shown.

Figure 3:
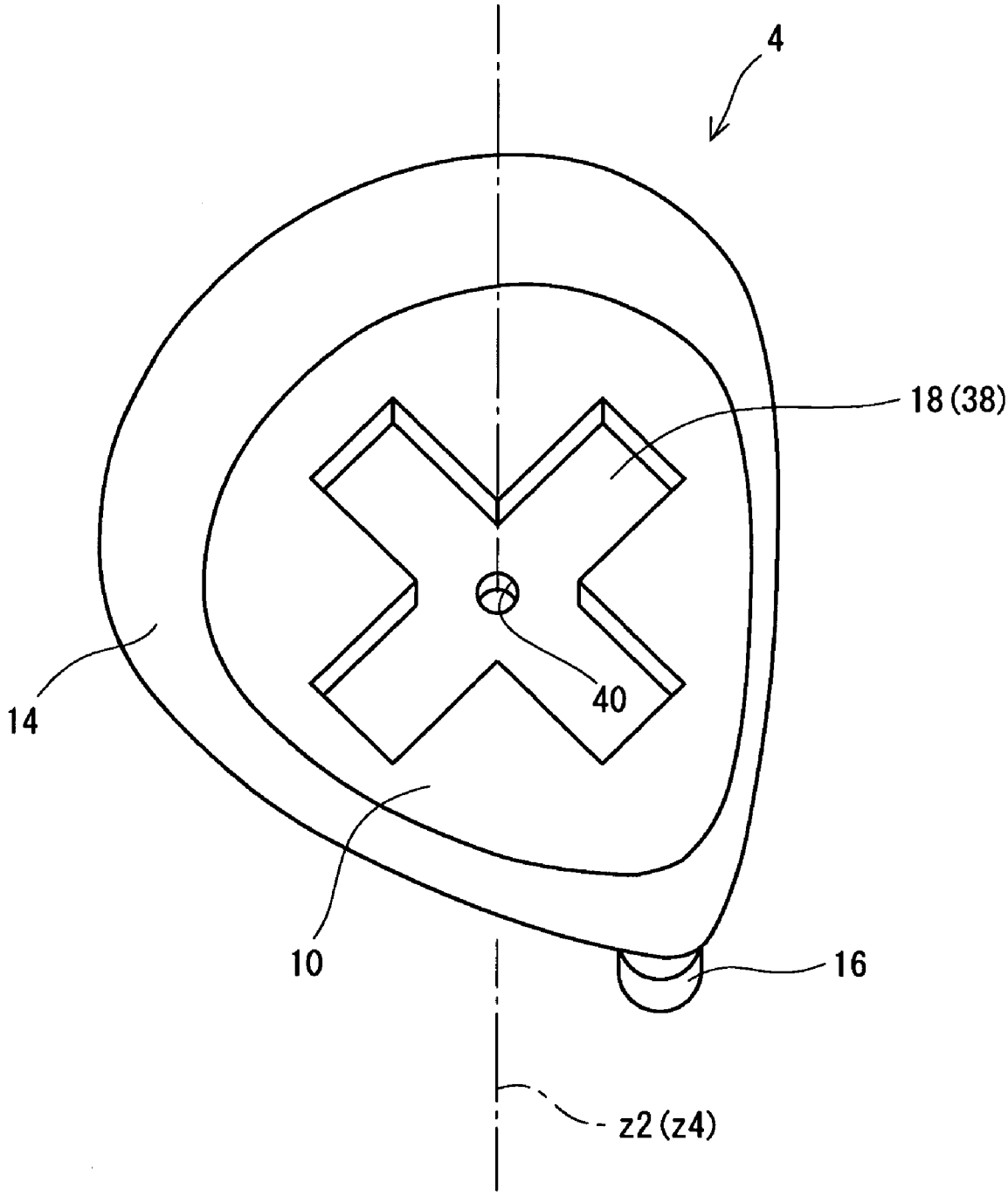
FIG. 3 is a perspective view showing a head body in the golf club head of FIG. 1.

FIG. 3 is a perspective view showing the head body 4. The head body 4 has a recess portion 18. The recess portion 18 is provided in the sole portion 10. The additional member 6 can be fitted in the recess portion 18. The whole additional member 6 can be fitted in the recess portion 18. In the head 2, the whole additional member 6 is accommodated in the recess portion 18.

The recess portion 18 takes a planer shape of a cross. The additional member 6 takes a planer shape of a cross. The planar shape of the recess portion 18 corresponds to that of the additional member 6.

In the additional member 6, a contour shape obtained by a projection onto a plane has a rotational symmetry. In the additional member 6, the contour shape obtained by the projection onto the plane has a rotational symmetric axis z1. The details of the rotational symmetry and the rotational symmetric axis z1 will be described below.

In the recess portion 18, a contour shape obtained by a projection onto a plane has a rotational symmetry. In the recess portion 18, the contour shape obtained by the projection onto the plane has a rotational symmetric axis z2. The details of the rotational symmetry and the rotational symmetric axis z2 will be described below.

Figure 4:
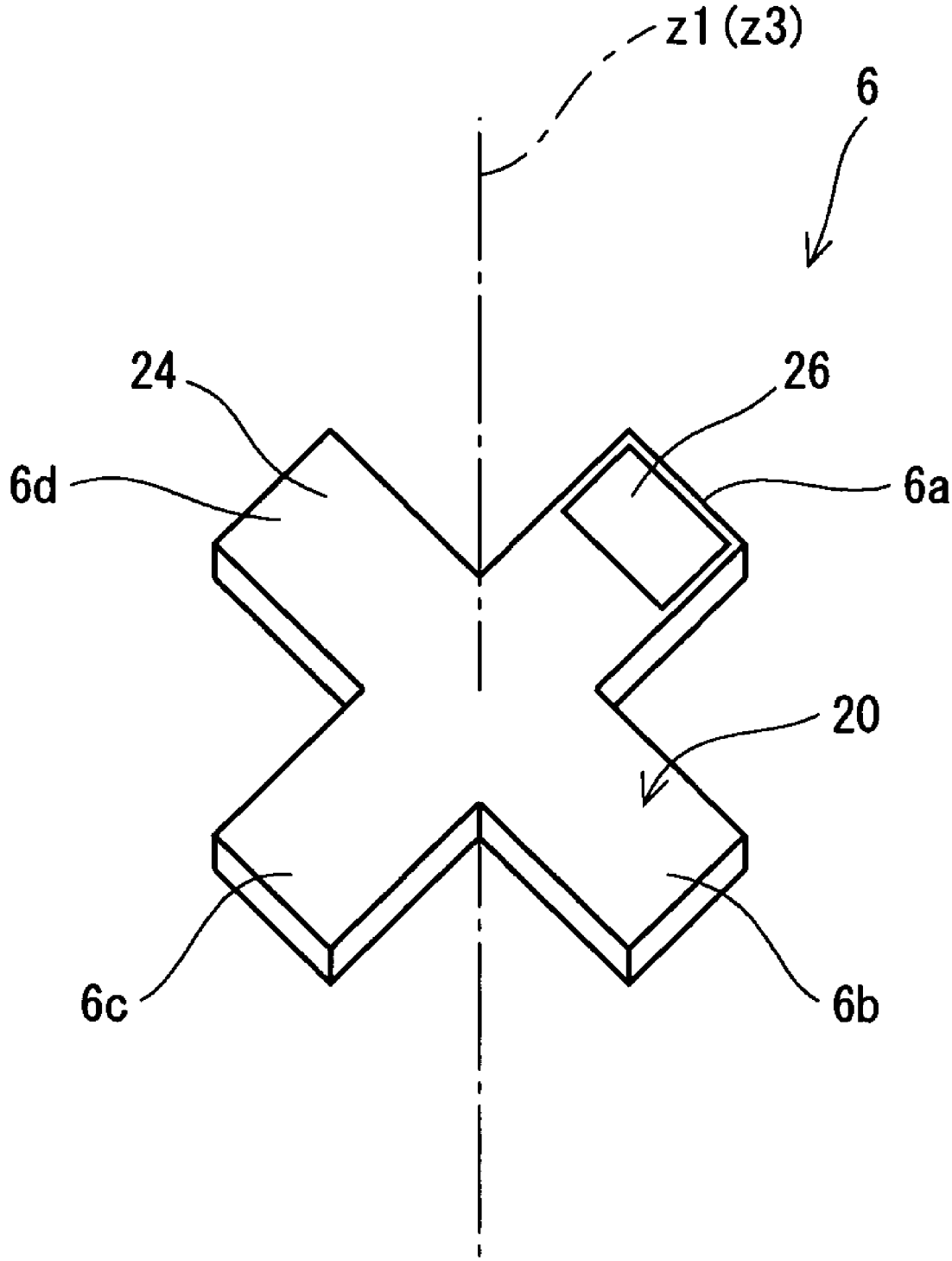
FIG. 4 is a perspective view showing an additional member in the golf club head of FIG. 1.
Figure 5:
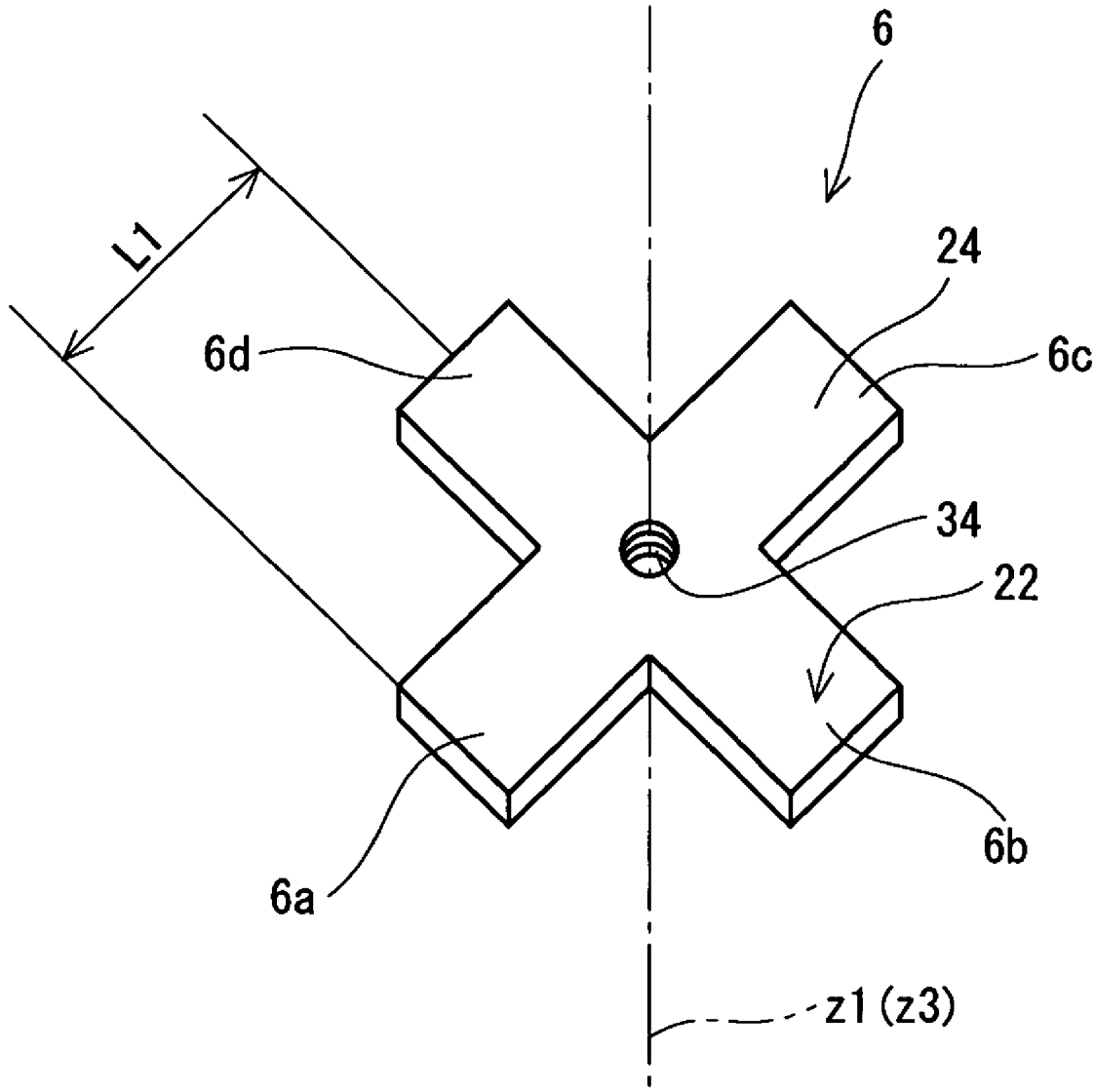
FIG. 5 is a perspective view showing the additional member of FIG. 4 as seen from a back side.

FIGS. 4 and 5 are perspective views showing the additional member 6. FIG. 4 is a perspective view showing the additional member 6 seen from a surface side. FIG. 5 is a perspective view showing the additional member 6 seen from a back side. The additional member 6 has an external surface 20 and an internal surface 22. In a state in which the additional member 6 is attached to the recess portion 18, the external surface 20 is exposed to an outside. In the state in which the additional member 6 is attached to the recess portion 18, the internal surface 22 abuts on a bottom face of the recess portion 18.

As shown in FIGS. 4 and 5, the additional member 6 has a first extended portion 6*a* which is extended in a first direction, a second extended portion 6*b* which is extended in a second direction, a third extended portion 6*c* which is extended in a third direction, and a fourth extended portion 6*d* which is extended in a fourth direction. An angle defined by the extending direction of the first extended portion 6*a* and that of the second extended portion 6*b* is 90 degrees. An angle defined by the extending direction of the second extended portion 6*b* and that of the third extended portion 6*c* is 90 degrees. An angle defined by the extending direction of the third extended portion 6*c* and that of the fourth extended portion 6*d* is 90 degrees. An angle defined by the extending direction of the fourth extended portion 6*d* and that of the first extended portion 6*a* is 90 degrees. The extending direction of the first extended portion 6*a* is reverse to that of the third extended portion 6*c*. The extending direction of the second extended portion 6*b* is reverse to that of the fourth extended portion 6*d*.

The additional member 6 has a body 24 and a separate member 26. The separate member 26 is fitted in a recess portion provided on the body 24. A material of the body 24 has a different specific gravity from that of a material of the separate member 26. Thus, the additional member 6 is formed by at least two materials having different specific gravities from each other. A center of gravity of the additional member 6 is not present on the rotational symmetric axis z1. The rotational symmetric axis z1 does not pass through the separate member 26.

Figure 6:
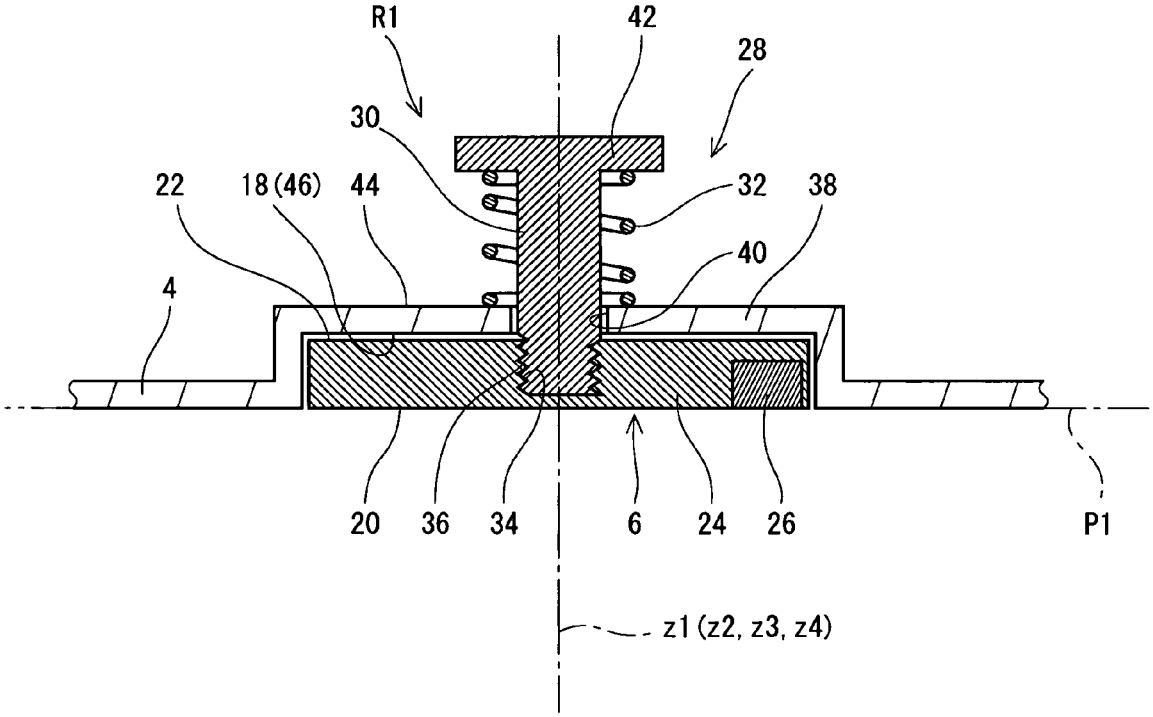
FIG. 6 is a sectional view taken along a VI-Vi line in FIG. 2.

FIG. 6 is a sectional view taken along a VI-VI line of FIG. 2. In FIG. 6, only the vicinity of the additional member 6 is shown and the other portions are not shown. As described above, the head 2 is hollow. An upper side in FIG. 6 indicates the hollow portion of the head 2 and a lower side in FIG. 6 indicates the outside of the head 2.

The head 2 includes a holding mechanism 28 for holding the additional member 6. The holding mechanism 28 has a bar-shaped member 30 and an elastic member 32. In the present embodiment, the elastic member 32 is a coil spring. The coil spring is a compression spring.

The bar-shaped member 30 is protruded from the internal surface 22 of the additional member 6. The additional member 6 is provided on one of ends of the bar-shaped member 30. The bar-shaped member 30 is a round bar. The bar-shaped member 30 and the additional member 6 are coupled to each other with a screw mechanism. A female screw hole 34 is provided on a center of the internal surface 22 of the additional member 6. A male screw portion 36 is provided on one of the ends of the bar-shaped member 30. The female screw hole 34 and the male screw portion 36 are screwed to each other.

A through hole 40 is provided on a bottom face portion 38 of the recess portion 18. The bar-shaped member 30 is inserted into the through hole 40. An inside diameter of the through hole 40 is greater than an outside diameter of the bar-shaped member 30. A central axis of the through hole 40 is coincident with the rotational symmetric axis z2.

An engaging portion 42 is provided on the other end of the bar-shaped member 30. In a state in which the bar-shaped member 30 and the engaging portion 42 are coupled to each other, the engaging portion 42 cannot be inserted through the through hole 40. The engaging portion 42 prevents the bar-shaped member 30 from dropping out.

A central axis of the bar-shaped member 30 is coincident with the rotational symmetric axis z1. A play is present between the bar-shaped member 30 and the through hole 40. Therefore, the rotational symmetric axes z2 and z1 are not always coincident with each other. A rotating member R1 which will be described below can be reciprocated in an axial direction of the through hole 40 with a posture in which the rotational symmetric axes z1 and z2 are coincident with each other.

An inside diameter of the elastic member 32 to be the coil spring is greater than an outside diameter of the bar-shaped member 30. The bar-shaped member 30 is inserted into an inside of the elastic member 32.

The elastic member 32 is provided between an internal surface 44 of the bottom face portion 38 and the engaging portion 42. One of ends of the elastic member 32 abuts on the internal surface 44 of the bottom face portion 38. The other end of the elastic member 32 abuts on the engaging portion 42. In an integrating state with the bar-shaped member 30, the engaging portion 42 cannot be inserted through the elastic member 32. A maximum diameter of the engaging portion 42 is greater than an inside diameter of the elastic member 32.

Figure 7:
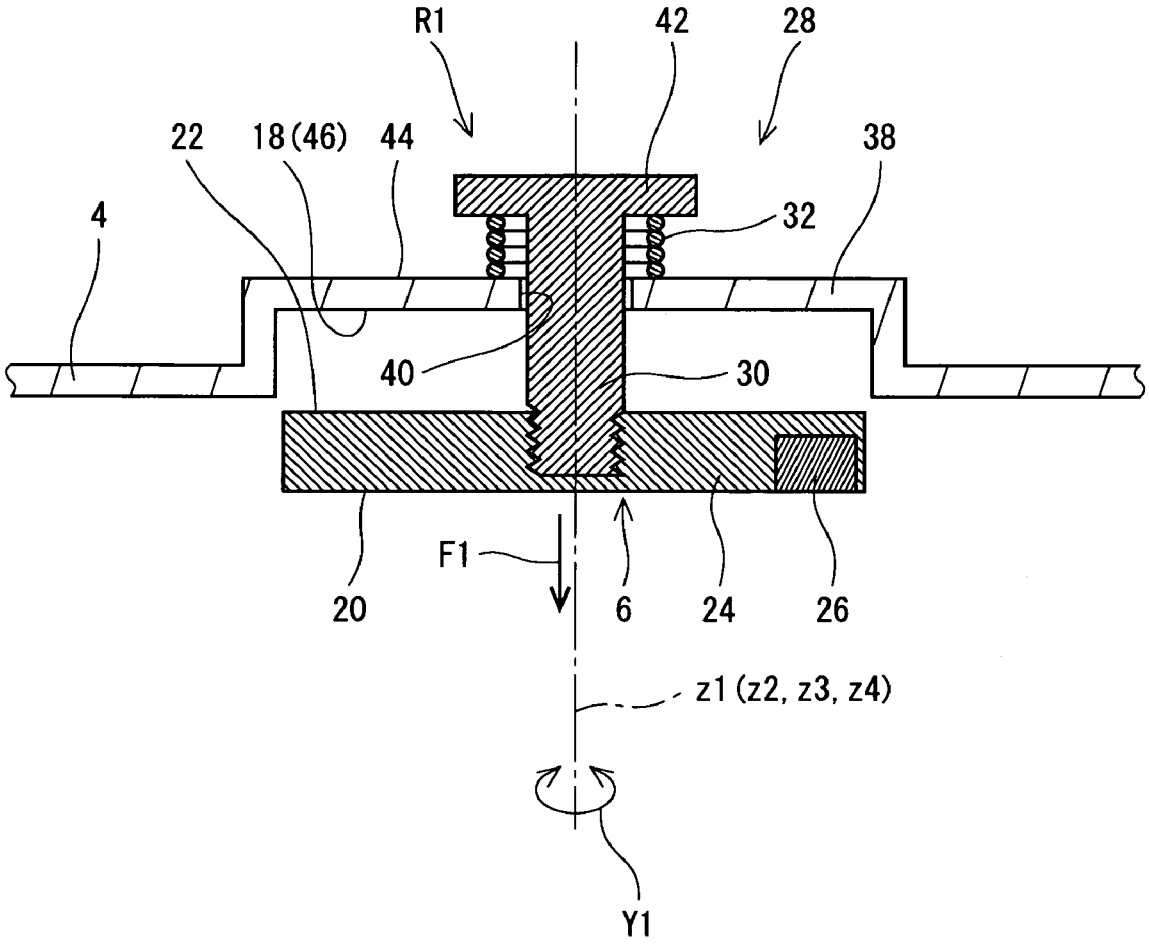
FIG. 7 is a sectional view showing a releasing state.

FIGS. 2 and 6 are views showing a holding state. When a golf play is to be carried out with a golf club having the head 2 attached thereto, the head 2 is brought into the holding state. On the other hand, FIG. 7 is a sectional view showing a releasing state. When the position of the center of gravity of the head 2 is to be adjusted, the head 2 is brought into the releasing state.

As described above, the elastic member 32 is the compression spring. In the holding state, the elastic member 32 tries to be extended more greatly. In the holding state shown in FIG. 6, the elastic member 32 performs biasing to increase an interval between the internal surface 44 of the bottom face portion 38 and the engaging portion 42. By the biasing force, the internal surface 22 of the additional member 6 and the bottom face 46 of the recess portion 18 abut on each other with a pressure. By the biasing force, the additional member 6 is reliably fitted in the recess portion 18.

In the head 2, it is possible to carry out a mutual transition of the holding state (FIG. 6) and the releasing state (FIG. 7). In order to carry out a transition from the holding state to the releasing state, it is preferable to apply an external force F1 (see FIG. 7) resisting the biasing force of the elastic member 32 to the additional member 6, thereby pulling the additional member 6 to an outside of the head 2 (a lower side in FIG. 6). In the releasing state of FIG. 7, the elastic member 32 is further compressed as compared with the holding state. In the releasing state, the additional member 6 perfectly slips out of the recess portion 18. In the releasing state, the recess portion 18 is disengaged from the additional member 6. In the releasing state, the additional member 6-can be rotated around the rotational symmetric axis z1.

The center of gravity of the rotating member R1 constituted by the additional member 6, the bar-shaped member 30 and the engaging portion 42 is not present on the rotational symmetric axis z1. When the additional member 6 is rotated, the rotating member R1 is rotated. The rotating member R1 is rotated around the rotational symmetric axis z1 so that the center of gravity of the head 2 is moved.

In the releasing state, the rotating member R1 can be rotated around the rotational symmetric axis z1. By the presence of the engaging portion 42, the rotating member R1 does not drop out of the head body 4 in the releasing state. In the head 2, it is possible to change the position of the center of gravity of the head 2 without removing the rotating member R1. By simply pulling and rotating the rotating member R1, it is possible to change the position of the center of gravity of the head 2.

The contour shape of the additional member 6 obtained by a projection onto a plane is four-fold rotational symmetric. The additional member 6 can take four types of phases in the holding state. In any of the phases, the additional member 6 can be fitted in the recess portion 18. In the holding state, the position of the center of gravity of the head 2 can be set into four ways.

An amount of compressive deformation of the elastic member 32 has a limit. It is possible to implement the releasing state without reaching the limit of the amount of compressive deformation of the elastic member 32. The elastic member 32 can be subjected to the compressive deformation to the extent that the releasing state can be brought. More specifically, the elastic member 32 is elastically deformable to take the releasing state.

In order to maintain the releasing state, it is necessary to continuously apply the external force F1 to the additional member 6. The additional member 6 is rotated with the external force F1 maintained (see an arrow Y1 in FIG. 7).

When the external force F1 is eliminated, the additional member 6 is attracted to the head body 4 by the biasing force of the elastic member 32. When the external force F1 is eliminated, the holding state can be recovered. In order to recover the holding state, it is necessary for the additional member 6 to be fitted into the recess portion 18. In order to recover the holding state, the additional member 6 is rotated to be fitted into the recess portion 18.

In the holding state, the additional member 6 cannot be rotated around the rotational symmetric axis z1. In the holding state, the additional member 6 is engaged with the recess portion 18 in such a manner that a rotation is inhibited from being carried out around the rotational symmetric axis z1. The additional member 6 is engaged with the recess portion 18 while the additional member 6 is maintained to be fitted in the recess portion 18 by the biasing force of the elastic member 32. In the holding state, thus, the additional member 6 is fixed to the head body 4. In the sectional views showing the holding state in FIG. 6 and the like, a small clearance is drawn between the recess portion 18 and the additional member 6. This is drawn for easy understanding of the drawings and the clearance is not actually present.

Figure 8:
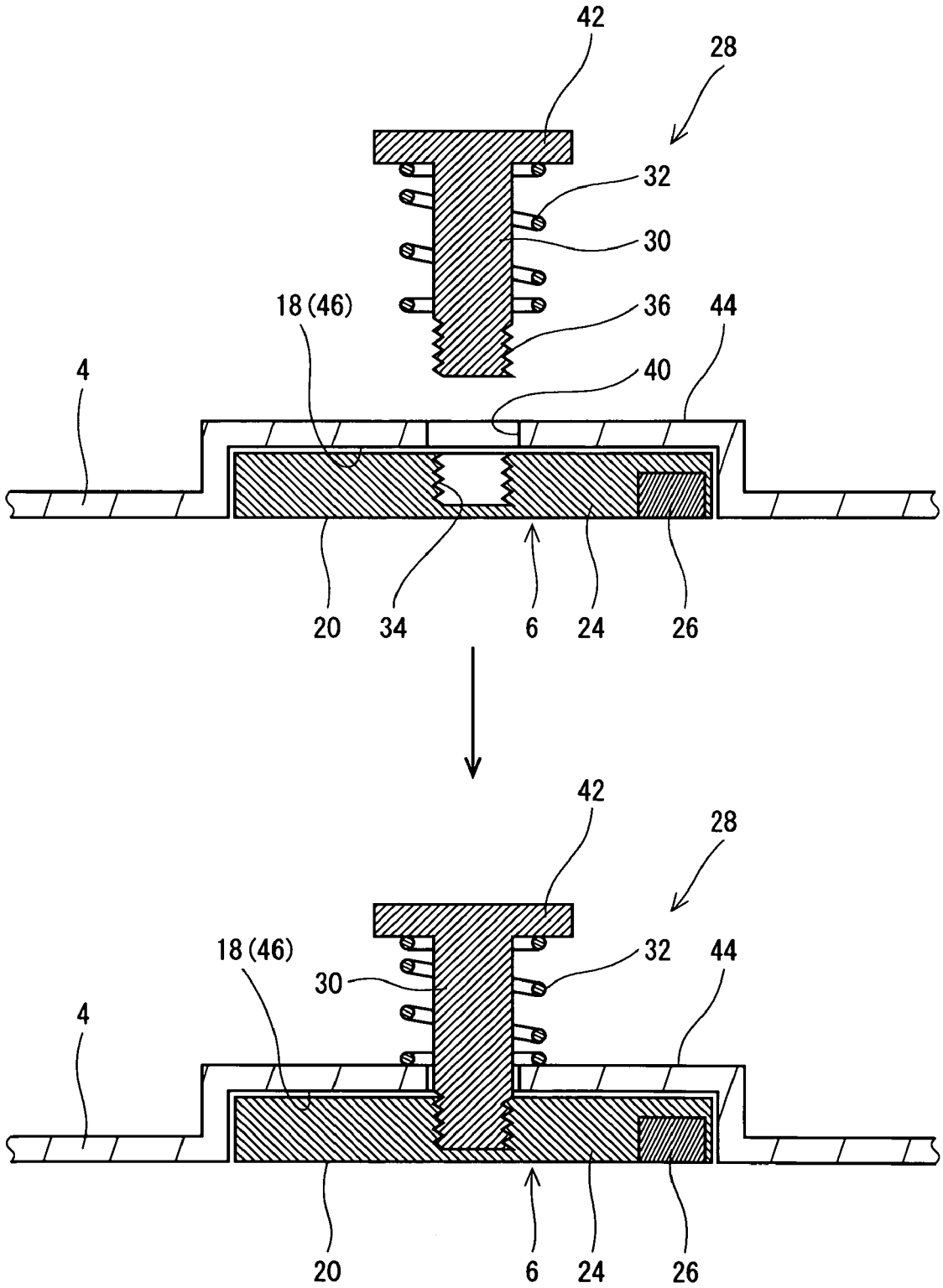
FIG. 8 is a view for explaining a procedure for assembling the head.

FIG. 8 is a view for explaining a step of assembling a holding mechanism 28. At this step, the bar-shaped member 30 which is integrated with the engaging portion 42 and the elastic member 32 are disposed on the inside (the hollow portion) of the head 2. On the other hand, the additional member 6 is disposed in the recess portion 18. Next, the bar-shaped member 30 is inserted into the elastic member 32. The drawing on an upper side of FIG. 8 shows this state. Then, the male screw portion 36 of the bar-shaped member 30 is inserted into the through hole 40 so that the male screw portion 36 is screwed into the female screw hole 34. By the screwing, a state shown in the drawing on a lower side of FIG. 8 is brought so that the holding mechanism 28 is completely assembled.

Figure 9:
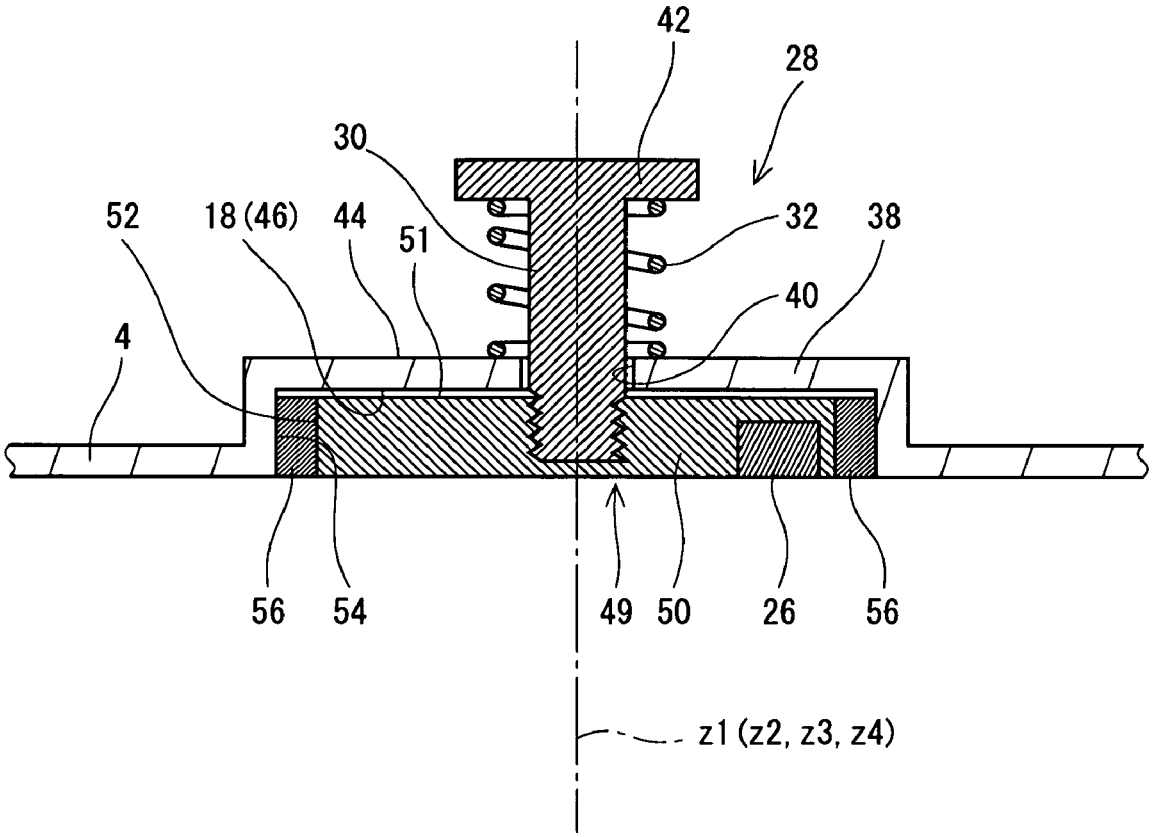
FIG. 9 is a sectional view showing a head according to another embodiment.

FIG. 9 is a sectional view showing a first variant of the embodiment in FIG. 6. A head according to the variant is the same as the head 2 except for an additional member 49. In the variant, the additional member 49 has an additional member body 50, a separate member 26 and an elastic member 56. The elastic member 56 is disposed in at least a part between a side surface 52 of the additional member body 50 and a wall surface 54 of the recess portion 18. In the holding state, the elastic member 56 abuts on the wall surface 54.

A microvibration might be generated in the additional member body 50 due to an impact in hitting. In some cases, the microvibration causes a durability of the additional member 49 to be deteriorated or a noise to be generated. The noise is generated when the additional member body 50 collides with the head body 4. The elastic member 56 can absorb the microvibration of the additional member body 50. By the elastic member 56, it is possible to enhance the durability of the additional member body 50. By the elastic member 56, it is possible to effectively prevent the noise from being generated.

Examples of a material of the elastic member 56 include a vulcanized rubber and a resin. Examples of the resin include a thermosetting resin and a thermoplastic resin. As an example of the resin, an elastomer containing a soft segment and a hard segment is taken. The elastic member 56 may be attached to the additional member body 50 or the recess portion 18. The elastic member 56 may be provided between a bottom face 46 of the recess portion 18 and an internal surface 51 of the additional member 49. The elastic member 56 can be attached with an adhesive agent, for example.

Figure 10:
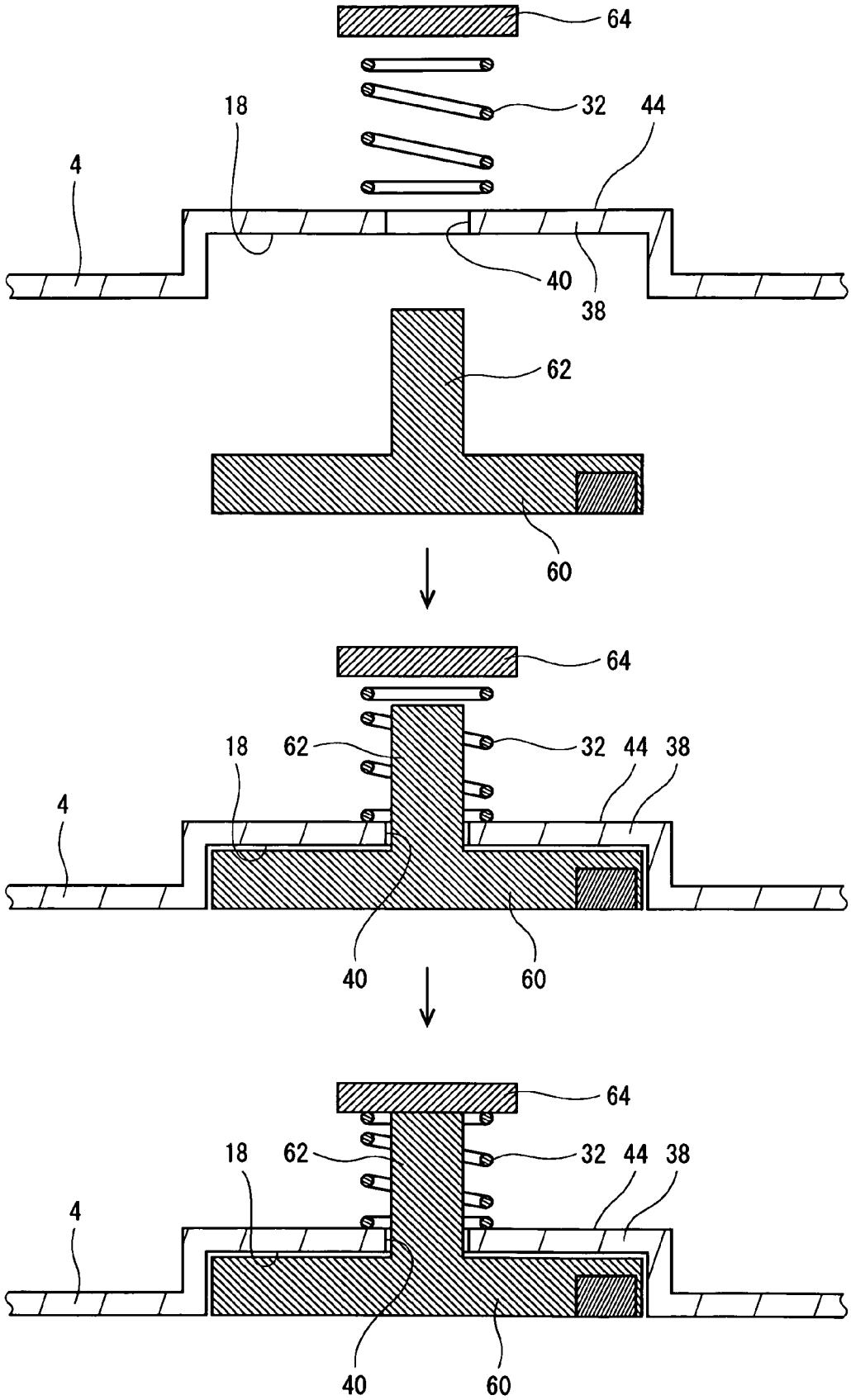
FIG. 10 is a view for explaining a procedure for assembling a head according to a further embodiment.

FIG. 10 is a sectional view showing an assembling step according to a second variant of the embodiment in FIG. 6. In the second variant, an additional member 60 and a bar-shaped member 62 are formed integrally. In the second variant, the bar-shaped member 62 and an engaging portion 64 are not formed integrally. Except for these respects, the second variant is the same as the head 2 described above.

At the assembling step according to the second variant, first of all, an elastic member 32 and an engaging portion 64 are disposed on an inside (a hollow portion) of a head, and an additional member 60 integrated with the bar-shaped member 62 is disposed on an outside of the head (see an upper stage of FIG. 10). Next, the bar-shaped member 62 is inserted into a through hole 40 and the bar-shaped member 62 protruded to the inside of the head is inserted through the elastic member 32 (see a middle stage of FIG. 10). Finally, the engaging portion 64 is attached to an end of the bar-shaped member 62 (see a lower stage of FIG. 10). Means for bonding the engaging portion 64 to the bar-shaped member 62 is not restricted but bonding, welding and screwing can be taken as an example.

Figure 11:
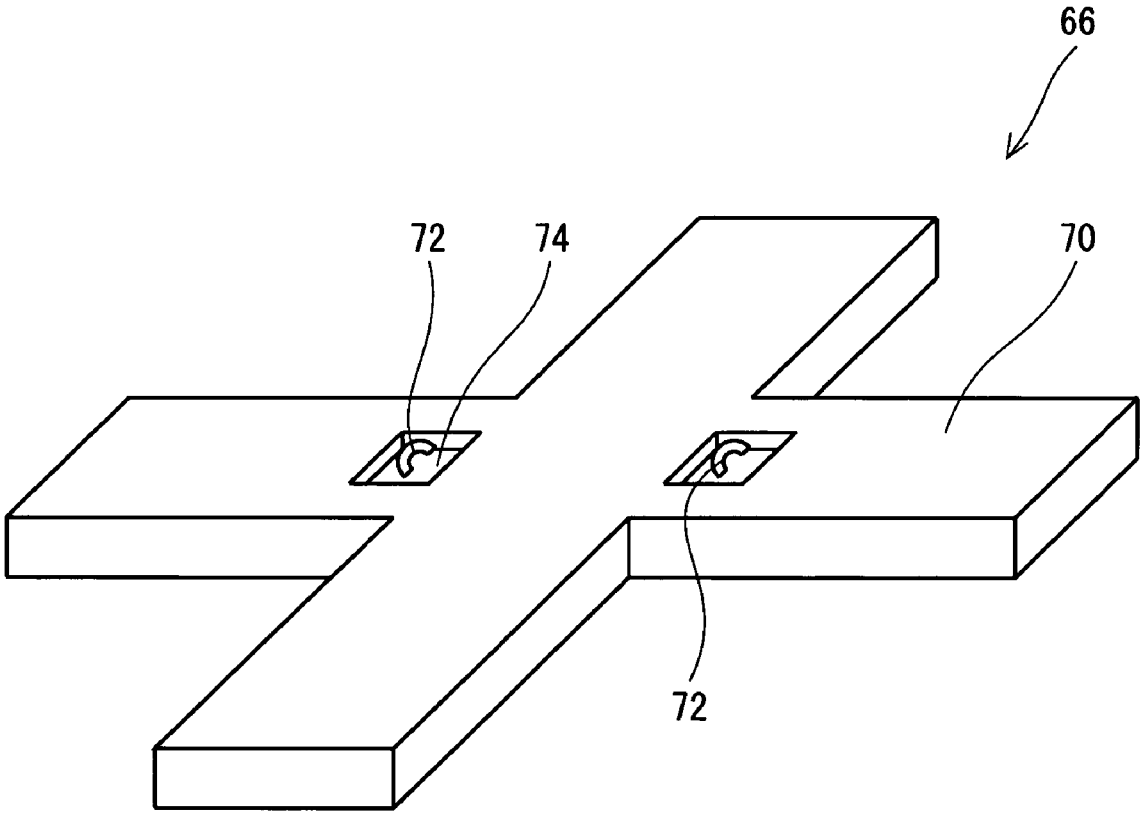
FIG. 11 is a perspective view showing an additional member according to the further embodiment.

FIG. 11 is a perspective view showing an additional member 66 according to a third variant. A hanging portion 72 for causing the external force F1 to easily act is provided on an external surface 70 of the additional member 66. A jig (not shown) having a hook or the like on an end is hung on the hanging portion 72 so that the external force F1 can easily be applied. The hanging portion 72 is provided in a recess portion 74 and is not protruded from the external surface 70.

Figure 12:
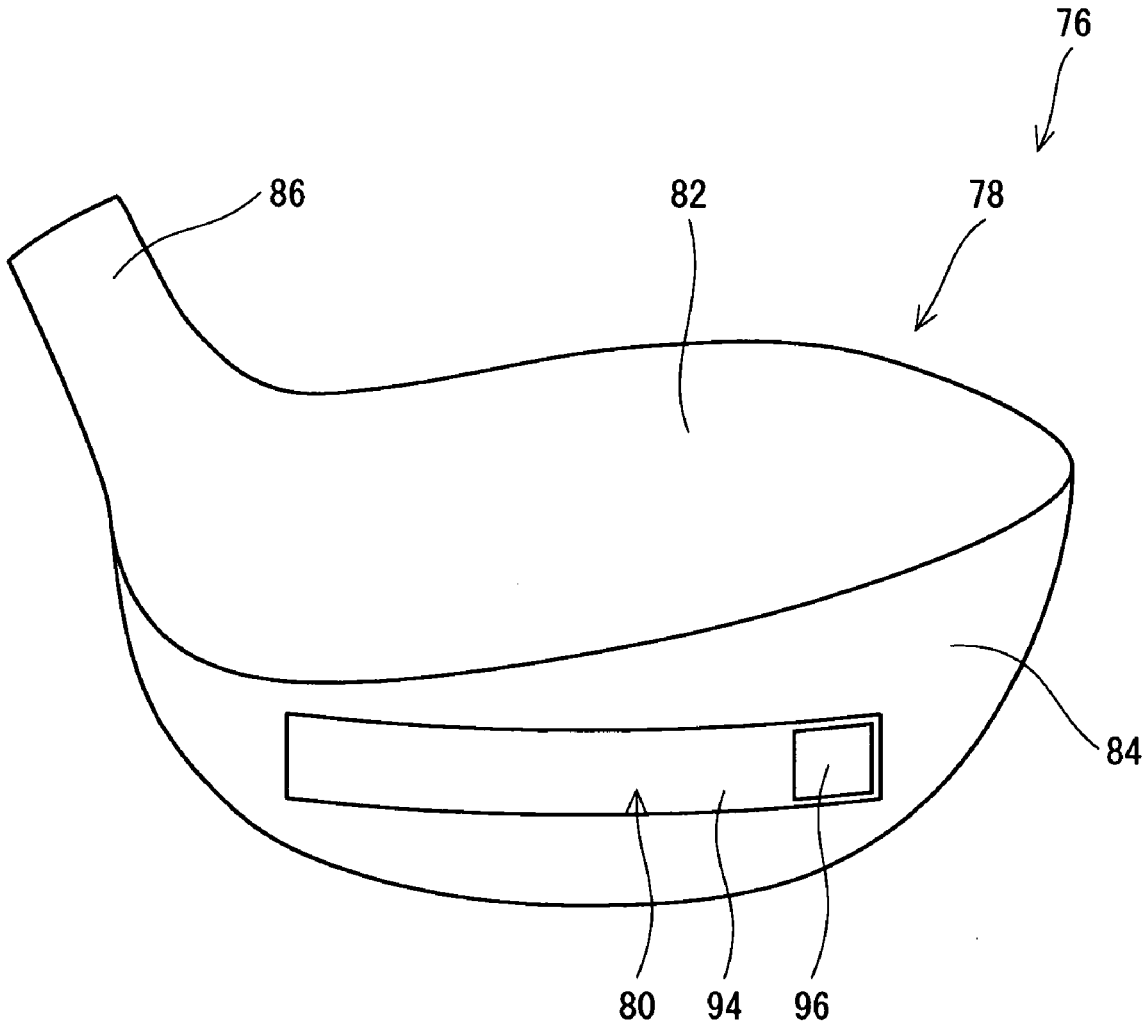
FIG. 12 is a view showing the head according to the further embodiment as seen from a back side.

FIG. 12 is a perspective view showing a head 76 according to another embodiment. FIG. 12 is a perspective view showing the head 76 seen from a back side. The head 76 includes a head body 78 and an additional member 80.

The head body 78 has a face portion which is not shown, a sole portion which is not shown, a crown portion 82, a side portion 84 and a hosel portion 86. An inner part of the head body 78 is hollow, which is not shown.

Figure 13:
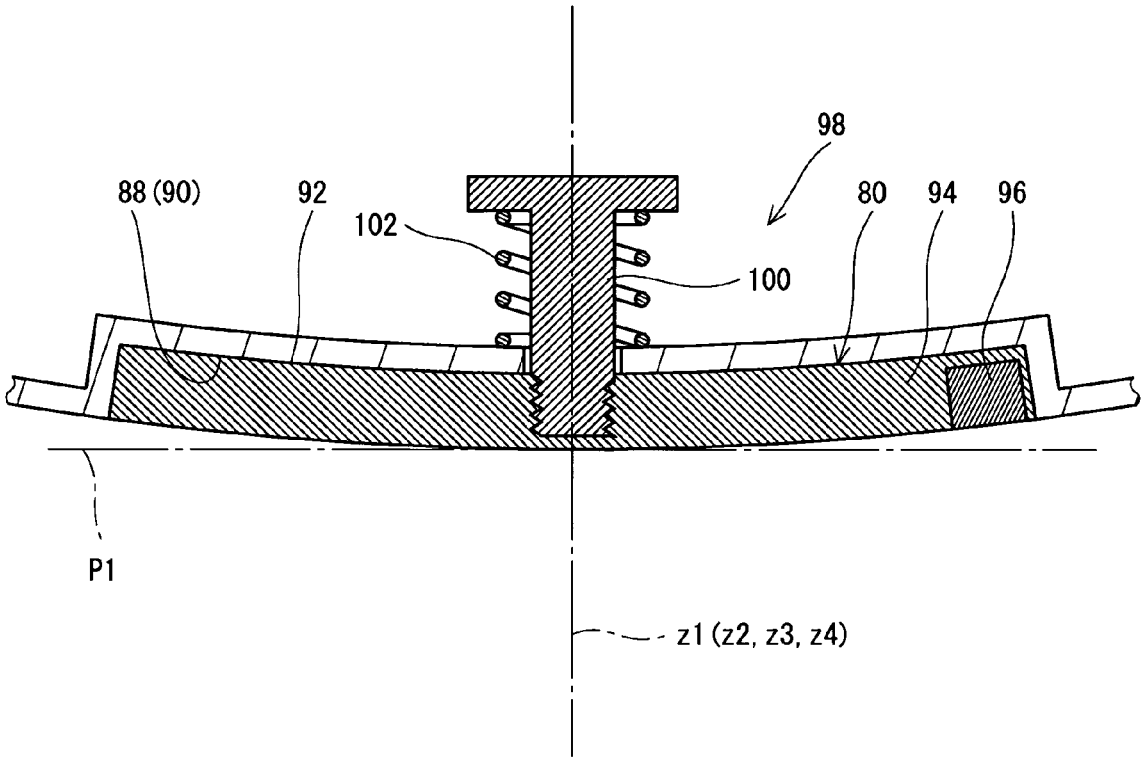
FIG. 13 is a sectional view showing the head of FIG. 12.

FIG. 13 is a sectional view showing the head 76 set in a longitudinal direction of the additional member 80. FIG. 13 shows only the vicinity of the additional member 80. A recess portion 88 is provided on the side portion 84. The additional member 80 can be fitted in the recess portion 88. The whole additional member 80 is fitted in the recess portion 88. In the head 76, the whole additional member 80 is accommodated in the recess portion 88.

The recess portion 88 has a planar shape of I. The additional member 80 has a planar shape of I. The planar shape of the recess portion 88 corresponds to that of the additional member 80.

In the additional member 80, a contour shape obtained by a projection onto a plane has a rotational symmetry. In the additional member 80, the contour shape obtained by the projection onto the plane has a rotational symmetric axis z1. The details of the rotational symmetry and the rotational symmetric axis z1 will be described below.

In the recess portion 88, a contour shape obtained by a projection onto a plane has a rotational symmetry. In the recess portion 88, the contour shape obtained by the projection onto the plane has a rotational symmetric axis z2. The details of the rotational symmetry and the rotational symmetric axis z2 will be described below.

In the embodiment shown in FIG. 6, the bottom face 46 of the recess portion 18 is a plane. On the other hand, a bottom face 90 of the recess portion 88 is a curved surface. In the embodiment shown in FIG. 6, an internal surface 22 of the additional member 6 is a plane. On the other hand, an internal surface 92 of the additional member 80 is a curved surface.

The additional member 80 has a body 94 and a separate member 96. The separate member 96 is fitted in a recess portion provided on the body 94. A material of the body 94 has a different specific gravity from that of a material of the separate member 96. Thus, the additional member 80 is formed by at least two materials having different specific gravities from each other. A center of gravity of the additional member 80 is not present on the rotational symmetric axis z1.

The head 76 includes a holding mechanism 98 for holding the additional member 80. The holding mechanism 98 has a bar-shaped member 100 and an elastic member 102. In the present embodiment, the elastic member 102 is a coil spring. The coil spring is a compression spring.

A structure of the holding mechanism 98 is the same as that of the holding mechanism 28. A mechanism for carrying out a mutual transition of a holding state and a releasing state is the same as that in the head 2.

Figure 14:
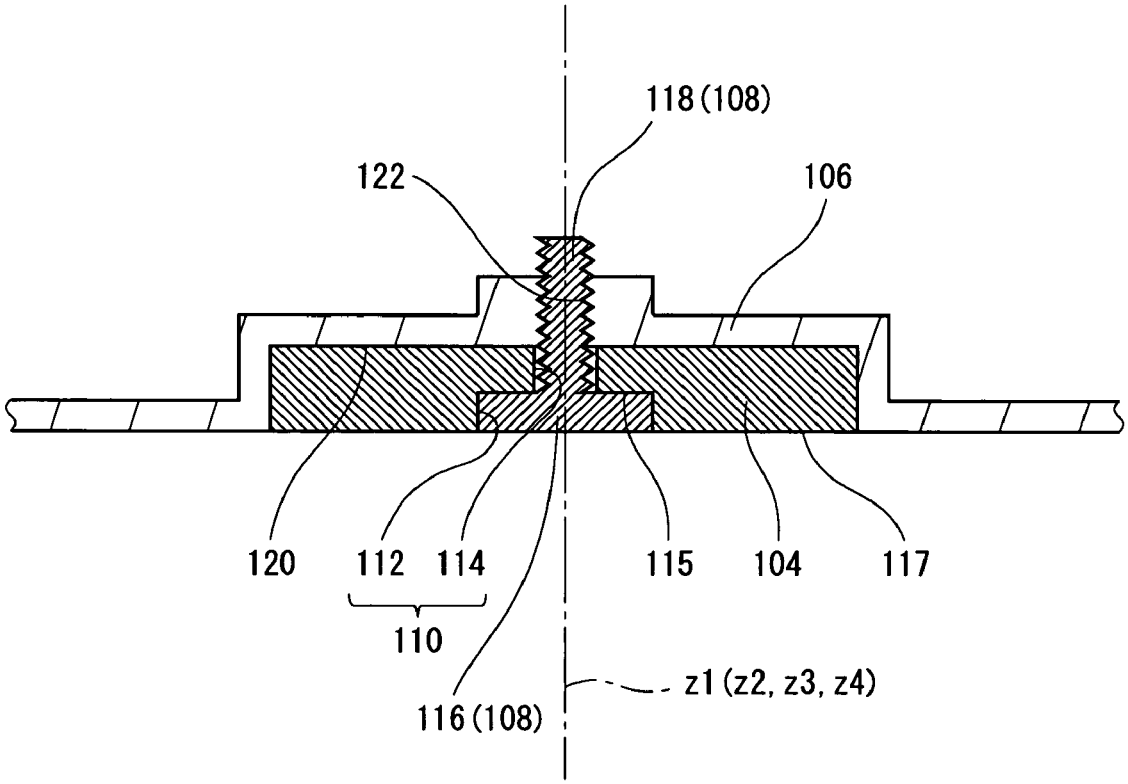
FIG. 14 is a sectional view showing a part of the head according to the further embodiment.

FIG. 14 is a sectional view showing a head according to a further embodiment. In the sectional view, the vicinity of an additional member 104 is shown. In the embodiment, an elastic member is not used. In the present embodiment, the additional member 104 and a head body 106 are fixed to each other through a screw member 108. A through hole 110 is provided on the additional member 104. The through hole 110 has a large diameter portion 112 and a small diameter portion 114. A step surface 115 is present on a boundary between the large diameter portion 112 and the small diameter portion 114. The screw member 108 has a head portion 116 and a male screw portion 118. The head body 106 has a recess portion 120. A female screw hole 122 is provided in a bottom face portion of the recess portion 120. The head portion 116 is accommodated in the large diameter portion 112 of the through hole 110. In the holding state, the head portion 116 is not protruded from an external surface 117 of the additional member 104.

FIG. 14 is a view showing the holding state. In the holding state, the head portion 116 of the screw member 108 abuts on the step surface 115. An inside diameter of the small diameter portion 114 is smaller than an outside diameter of the head portion 116. The head portion 116 is not inserted into the small diameter portion 114. On the other hand, an outside diameter of the male screw portion 118 is smaller than the inside diameter of the small diameter portion 114. In the holding state, the male screw portion 118 is screwed into the female screw hole 122. By the screwing, the additional member 104 is fixed to the head body 106. In order to bring the releasing state, the male screw portion 118 and the female screw hole 122 are unscrewed to pull the additional member 104 out of the recess portion 120. In the releasing state, the additional member 104 can be rotated around a rotational symmetric axis z1. In a stage in which the male screw portion 118 and the female screw hole 122 are not perfectly unscrewed, the releasing state is implemented. In order to implement the releasing state with the male screw portion 118 and the female screw hole 122 maintained to be screwed, a length of the male screw portion 118, a length of the female screw hole 122 and a thickness of the additional member 104 are regulated. In the present invention, such a configuration may be employed.

Figure 15:
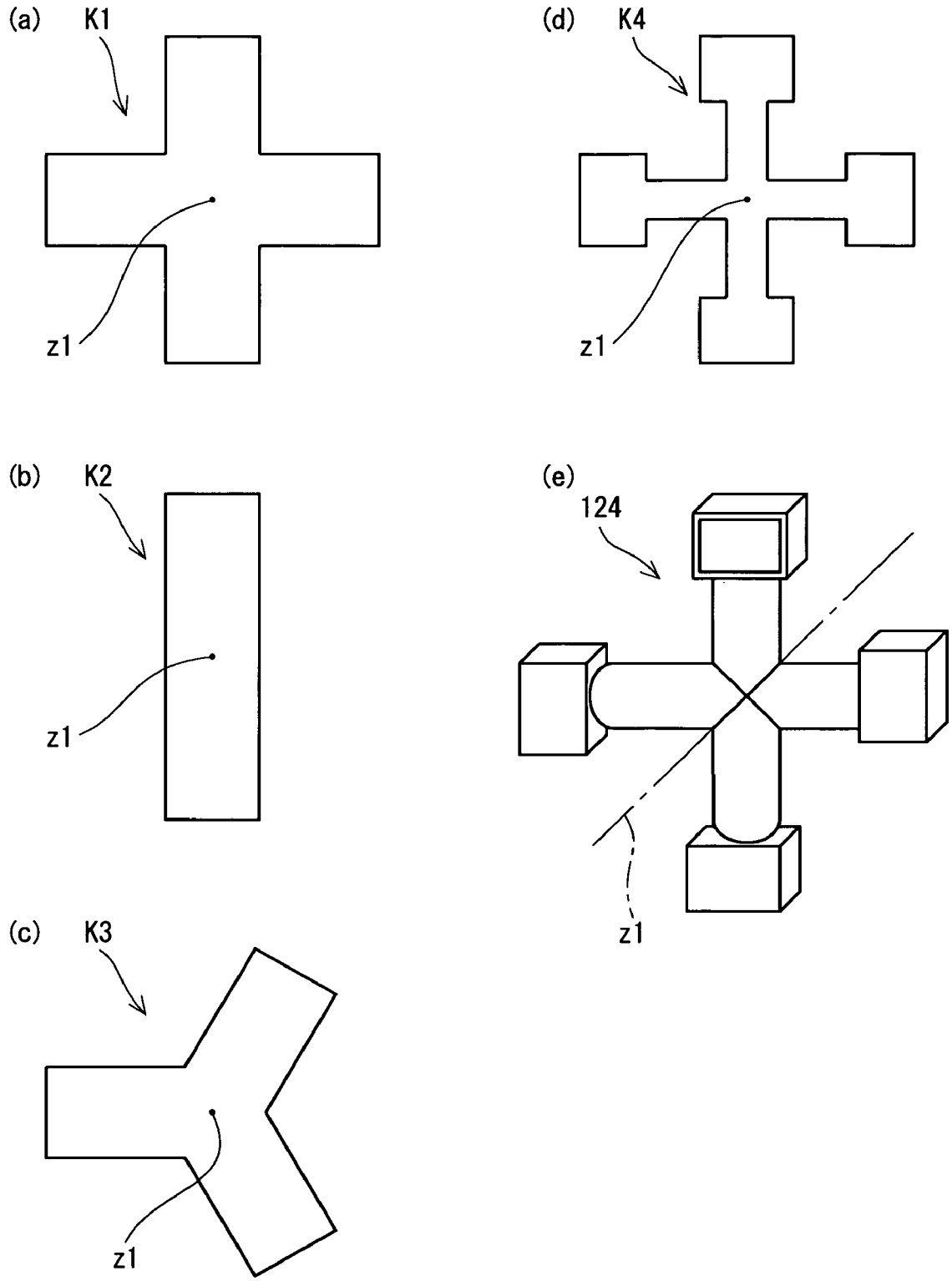
FIG. 15 is a view for explaining various additional members.

In each of the embodiments described above, the contour shape of the additional member which is obtained by a projection onto a plane has the rotational symmetric axis z1. FIG. 15 shows an example of the contour shape obtained by the projection onto the plane. FIG. 15(*a*) shows a contour shape K1 obtained by projecting the additional member 6 onto a plane P1. The plane P1 is shown in a one-dotted chain line in FIGS. 6 and 13. The rotational symmetric axis z1 is a rotational symmetric axis for the contour shape obtained by the projection onto the plane P1. The plane P1 is set to abut on the external surface of the additional member on at least one point. The projection onto the plane P1 is carried out in a perpendicular direction to the plane P1. It is preferable to set the plane P1 in order to obtain a projected image having the rotational symmetric axis. The rotational symmetric axis z1 passes through a center of gravity of the contour shape K1 and is perpendicular to the plane P1. In the case in which the contour shape has a plurality of rotational symmetric axes, one of them can be employed as the rotational symmetric axis z1 in the present invention.

FIG. 15(*b*) shows a contour shape K2 obtained by projecting the additional member 80 onto the plane P1. FIG. 15(*c*) shows a contour shape K3 obtained by projecting the additional member according to another example onto the plane P1. FIG. 15(*d*) shows a contour shape K4 obtained by projecting the additional member according to a further example onto the plane P1. FIG. 15(*e*) is a perspective view showing an example of an additional member 124 having the contour shape K4.

In the present invention, it is sufficient that the contour shape obtained by the projection onto the plane P1 has a rotational symmetry and the additional member itself does not need to have the rotational symmetry. In the present invention, the additional member itself does not need to have the rotational symmetric axis.

As a matter of course, the additional member itself may have the rotational symmetry as in the additional member 6 or 80.

In the additional member 6 according to the embodiment, the external surface 20 is a plane and the internal surface 22 is also a plane, and the additional member 6 has a constant thickness. The additional member 6 itself has the rotational symmetry. In the additional member 6 according to the embodiment, the rotational symmetric axis z1 of the contour shape is coincident with a rotational symmetric axis z3 of the additional member 6. In other words, the additional member 6 has the rotational symmetric axis z3 which is coincident with the rotational symmetric axis z1 of the contour shape. The rotational symmetric axis z3 is owned by the additional member 6 itself. The additional member 6 has a plurality of rotational symmetric axes and one of them serves as the rotational symmetric axis z3.

In the additional member 80, the rotational symmetric axis z1 of the contour shape is coincident with the rotational symmetric axis z3 of the additional member 80.

The additional member according to the present invention is not restricted to the case in which the additional member has the rotational symmetry as in the additional member 6. For example, it is also possible to employ an additional member A1 (not shown) in which the contour shape obtained by the projection onto the plane P1 is the same as that of the additional member 6 and a thickness is not constant. A rotational symmetric axis z1 of the additional member A1 is the same as the rotational symmetric axis z1 of the additional member 6. Examples of the additional member A1 include an additional member in which the first extended portion 6*a*, the second extended portion 6*b*, the third extended portion 6*c* and the fourth extended portion 6*d* have different thicknesses from each other. In case of the additional member in which the extended portions 6*a* to 6*d* have the different thicknesses from each other, it is possible to shift a position of a center of gravity of the additional member from the rotational symmetric axis z1 without providing the separate member 26.

In the embodiment, the contour shape obtained by projecting the recess portion 18 onto the plane P1 is substantially the same as the contour shape obtained by projecting the additional member 6 onto the plane P1. The rotational symmetric axis z2 serves as a rotational symmetric axis of the contour shape obtained by projecting the recess portion 18 onto the plane P1.

In the present invention, the contour shape of the recess portion which is obtained by the projection onto the plane does not need to have the rotational symmetry. In a state in which the additional member is fitted in the recess portion, it is sufficient that a rotation can be inhibited from being carried out around the rotational symmetric axis z1 of the additional member. In order to inhibit the rotation more reliably, it is preferable that the contour shape of the recess portion should have the rotational symmetric axis z2. In order to reliably inhibit the rotation, it is more preferable that the contour shape of the recess portion which is obtained by the projection onto the plane P1 should be the same as the contour shape of the additional member which is obtained by the projection onto the plane P1. In order to reliably inhibit the rotation, it is preferable that the whole side surface of the additional member should be close to the wall surface of the recess portion with substantively no clearance in the holding state.

As a matter of course, the recess portion (the recess portion itself) may have a rotational symmetric axis z4. The recess portion 18 of the head body 4 has a rotational symmetry. In the recess portion 18, the rotational symmetric axis z2 of the contour shape obtained by the projection is coincident with the rotational symmetric axis z4 of the recess portion 18. In other words, the recess portion 18 has the rotational symmetric axis z4 which is coincident with the rotational symmetric axis z2 of the contour shape. The rotational symmetric axis z4 means a symmetric axis of the recess portion 18 itself. The recess portion 18 has a plurality of rotational symmetric axes, and one of the rotational symmetric axes serves as the rotational symmetric axis z4.

The case in which a shape obtained with a rotation of (360/N) degrees around a certain axis is coincident with an original shape indicates an "N-fold rotational symmetry" with respect to the same axis. Every shape is one-fold rotational symmetric. For this reason, the case in which N is one is not regarded to have the rotational symmetry. When N is a natural number of two or more, it is regarded to have the rotational symmetry. The contour shape K1 shown in FIG. 15 is four-fold rotational symmetric. The contour shape K2 shown in FIG. 15 is two-fold rotational symmetric. The contour shape K3 shown in FIG. 15 is three-fold rotational symmetric. The contour shape K4 shown in FIG. 15 is four-fold rotational symmetric.

In the case in which the contour shape is the N-fold rotational symmetric, the additional member brought into the holding state can take N types of phases. In this case, accordingly, it is possible to adjust the position of the center of gravity of the head in N ways. In order to increase the degree of freedom for the adjustment of the position of the center of gravity, N is preferably equal to or greater than three and is more preferably equal to or greater than four in the contour shape of the additional member. In the case in which the shape of the additional member is excessively complex, a manufacturing cost of the additional member is excessively increased or a work for fitting the additional member in the recess portion is complicated when a transition from the releasing state to the holding state is carried out. From this viewpoint, N is preferably equal to or smaller than 20, is more preferably equal to or smaller than 12 and is further preferably equal to or smaller than eight.

In order to obtain a head which is not excessively light, a specific gravity H1 of the head body is preferably equal to or greater than two, is more preferably equal to or greater than 2.5 and is further preferably equal to or greater than three. In order to increase a weight which can be distributed to the additional member, thereby enhancing the degree of freedom for a movement of the center of gravity, the specific gravity H1 of the head body is preferably equal to or smaller than ten, is more preferably equal to or smaller than eight and is further preferably equal to or smaller than six.

In order to increase a strength of the additional member, a specific gravity H2 of the body of the additional member is preferably equal to or greater than 0.5, is more preferably equal to or greater than 0.8 and is further preferably equal to or greater than 1.0. In order to prevent the weight of the head from being increased excessively, the specific gravity H2 is preferably equal to or smaller than five, is more preferably equal to or smaller than four and is further preferably equal to or smaller than three.

It is preferable that the specific gravity H2 should be smaller than the specific gravity H1. By setting H2<H1, it is possible to reduce the weight of the body of the additional member, thereby distributing the extra weight to other portions.

In order to enhance the effect of adjusting the position of the center of gravity, a specific gravity H3 of a separate member of the additional member is preferably equal to or greater than five, is more preferably equal to or greater than six and is further preferably equal to or greater than seven. In order to prevent the weight of the head from being increased excessively, the specific gravity H3 is preferably equal to or smaller than 20, is more preferably equal to or smaller than 18 and is further preferably equal to or smaller than 16.

It is preferable that the specific gravity H3 should be greater than the specific gravity H1. By setting H1<H3, it is possible to enhance the effect of adjusting the position of the center of gravity through the additional member.

In order to enhance the effect of adjusting the position of the center of gravity, (H3/H1) is preferably equal to or greater than 1.5, is more preferably equal to or greater than two and is further preferably equal to or greater than 2.5. In order to prevent an excessive reduction in the weight of the head body or to prevent an excessive increase in the weight of the additional member, (H3/H1) is preferably equal to or smaller than seven, is more preferably equal to or smaller than six and is further preferably equal to or smaller than five.

If (H3/H2) is too small, the additional member is excessively heavy or the effect of adjusting the position of the center of gravity is reduced. From this viewpoint, (H3/H2) is preferably equal to or greater than three, is more preferably equal to or greater than four and is further preferably equal to or greater than five. If (H3/H2) is too great, a weight of the body of the additional member is excessively reduced so that the strength of the additional member is apt to be reduced or the weight of the additional member is apt to be increased excessively. In this respect, (H3/H2) is preferably equal to or smaller than 18, is more preferably equal to or smaller than 14 and is further preferably equal to or smaller than 12.

If (H1/H2) is too small, the weight of the additional member is increased excessively or the weight of the head body is apt to be reduced excessively. From this viewpoint, (H1/H2) is preferably equal to or greater than one, is more preferably equal to or greater than 1.2 and is further preferably equal to or greater than 1.5. In order to obtain a head which is not excessively light, (H1/H2) is preferably equal to or smaller than eight, is more preferably equal to or smaller than six and is further preferably equal to or smaller than four.

In order to enhance the effect of adjusting the position of the center of gravity, a distance Dz (the shortest distance) between the rotational symmetric axis z1 and the center of gravity of the additional member is preferably equal to or greater than 5 mm, is more preferably equal to or greater than 8 mm and is further preferably equal to or greater than 10 mm. In order to take a shape of the head with which a golf player feels uncomfortable with difficulty, the distance Dz is preferably equal to or smaller than 80 mm, is more preferably equal to or smaller than 60 mm and is further preferably equal to or smaller than 50 mm.

For a material of the head body, it is possible to use the same material as a general golf club head. Examples of the material include at least one selected from titanium, a titanium alloy, stainless steel, an aluminum alloy, a magnesium alloy and CFRP (carbon fiber reinforced plastic). In respect of a specific strength, the titanium alloy is suitable.

A method of manufacturing the head body is not particularly restricted but casting, forging and press forming can be taken as an example. Examples of a structure of the head body include a two-piece structure obtained by combining two members which are integrally formed respectively, a three-piece structure obtained by combining three members which are integrally formed respectively, a fourth-piece structure obtained by combining four members which are integrally formed respectively, and the like. Examples of the head body having the two-piece structure include a head body constituted by a member having a face opened and a face member, a head body constituted by a member having a crown opened and a crown member, and the like. Examples of the head body having the three-piece structure include a head body constituted by a member having a face and a crown opened, a face member and a crown member. Examples of the head body having the four-piece structure include a head body constituted by a face member, a crown member, a sole member and a hosel member.

Examples of a material of the body of the additional member include a metal and a resin. In order to set the specific gravity H2 into a preferable range, examples of a preferable metal include a titanium alloy, an aluminum alloy and a magnesium alloy. Examples of the resin include engineering plastic, superengineering plastic and CFRP (carbon fiber reinforced plastic). Examples of the engineering plastic include polycarbonate (PC), polyamide (PA), polyethylene terephthalate (PET), polybutylene terephthalate (PBT), polyacetal (POM), polyphenylene ether (PPE), and the like. Examples of the superengineering plastic include polyphenylene sulfide (PPS), polyether ether ketone (PEEK), polyether nitrile (PEN), polysulfone (PSE), polyether sulfone (PES), polyallylate (PAR), polyamide-imide (PAI), polyether-imide (PEI), thermoplastic polyimide (PI) and the like.

Examples of the material of the separate member in the additional member include a metal. In order to set the specific gravity H3 into a preferable range, examples of the material of the separate member include tungsten, a tungsten alloy, stainless steel, copper, a copper alloy, lead, a lead alloy and the like. Examples of the tungsten alloy include a W—Ni alloy (a tungsten nickel alloy) and a W—Cu alloy (a tungsten copper alloy).

EXAMPLES

Although the effects of the present invention will be apparent from examples, the present invention should not be construed to be restrictive based on description of the examples.

Example 1

The same head as the head 2 was fabricated. A head body was set to have a two-piece structure constituted by a member having a face opened (which will be hereinafter referred to as a face opening member) and a face member. A material of the face opening member was set to be Ti-6Al-4V (a specific gravity of 4.42). A material of the face member was set to be Ti-6Al-4V. The face opening member was integrally formed through casting. By the casting, a recess portion was formed on a sole portion. A through hole positioned on a center of the recess portion was formed through an NC processing.

A material of a body of an additional member was set to be an aluminum alloy (a specific gravity of 2.8). A recess portion for accommodating a separate member was provided on the body of the additional member through the NC processing. A female screw hole was provided on the body of the additional member through cutting. A separate member formed of a tungsten alloy (a specific gravity of 16) was fitted in the recess portion. The body of the additional member and the separate member were bonded to each other with an adhesive agent. A distance L1 (see FIG. 5) from the rotational symmetric axis z1 to an end face of the first extended portion 6*a* was set to be 35 mm. A distance L2 (not shown) from the rotational symmetric axis z1 to an end face of the second extended portion 6*b* was also set to be 35 mm. A distance L3 (not shown) from the rotational symmetric axis z1 to an end face of the third extended portion 6*c* was also set to be 35 mm. A distance L4 (not shown) from the rotational symmetric axis z1 to an end face of the fourth extended portion 6*d* was also set to be 35 mm. A thickness of the additional member was set to be constant, that is, 5 mm. A material of an integral member constituted by a bar-shaped member and an engaging portion was set to be an aluminum alloy (a specific gravity of 2.8). An outside diameter of the bar-shaped member was set to be 5 mm. A length of the bar-shaped member was set to be 15 mm. A length of the engaging portion in an axial direction of the bar-shaped member was set to be 2 mm. An outside diameter of the engaging portion was set to be 15 mm. For a material of a coil spring, spring steel SUP9 was used. In accordance with the procedure described with reference to FIG. 8, the additional member, the bar-shaped member, the coil spring and the engaging portion were attached to the face opening member. Then, the face opening member and the face member were bonded through plasma welding so that the head was obtained. In the present example, four types of head center-of-gravity positions were implemented in the holding state. In the present example, it was possible to move the center of gravity of the head without removing the rotating member.

The above description is only illustrative and various changes can be made without departing from the scope of the present invention.

The present invention can be applied to all of golf club heads, for example, a golf club head of a wood type, a golf club head of an iron type, a patter head and the like.

What is claimed is:

1. A golf club head comprising a head body, an additional member in which a contour shape obtained by a projection onto a plane has a rotational symmetric axis, and a holding mechanism for holding the additional member, wherein the head body has a recess portion in which at least a part of the additional member can be fitted, the holding mechanism is constituted to enable a mutual transition of a holding state in which the additional member is held in the recess portion and a releasing state in which the hold is released, the recess portion inhibits a rotation around the rotational symmetric axis of the additional member in the holding state, the additional member is rotatable around the rotational symmetric axis in the releasing state, and a phase of the additional member in the holding state is changed so that a position of a center of gravity of the head can be varied.

2. The golf club head according to claim 1, wherein the contour shape of the additional member is N-fold rotational symmetric, and N is a natural number of three or more.

3. The golf club head according to claim 1, wherein a through hole is provided on a bottom face portion of the recess portion, a bar-shaped member which can be inserted into the through hole is protruded from an internal surface of the additional member, one of ends of the bar-shaped member is provided with the additional member, the other end of the bar-shaped member is provided with an engaging portion which cannot be inserted into the through hole, a central axis of the bar-shaped member is coincident with the rotational symmetric axis of the additional member, the bar-shaped member is inserted into the through hole, and the internal surface of the additional member abuts on the bottom face of the recess portion in the holding state.

4. The golf club head according to claim 3, wherein the additional member is formed by at least two materials having different specific gravities from each other, an elastic member is provided between an internal surface of the bottom face portion and the engaging portion, the elastic member performs biasing to increase an interval between the internal surface of the bottom face portion and the engaging portion in the holding state, and the elastic member is elastically deformable to take the releasing state.

5. The golf club head according to claim 4, wherein an elastic member is disposed in at least a part between a side surface of the additional member and a wall surface of the recess portion.

* * * * *